US006266936B1

(12) United States Patent
Gelin

(10) Patent No.: US 6,266,936 B1
(45) Date of Patent: Jul. 31, 2001

(54) SOUND ATTENUATING AND THERMAL INSULATING WALL AND CEILING ASSEMBLY

(75) Inventor: Lawrence J. Gelin, Littleton, CO (US)

(73) Assignee: Johns Manville International, Inc., Denver, CO (US)

( * ) Notice: Subject to any disclaimer, the term of this patent is extended or adjusted under 35 U.S.C. 154(b) by 0 days.

(21) Appl. No.: 09/344,296

(22) Filed: Jun. 24, 1999

(51) Int. Cl.[7] ..... E04B 2/30; E04C 2/34
(52) U.S. Cl. ..... 52/481.1; 52/489.2; 52/712
(58) Field of Search ..... 52/346, 347, 481.1, 52/481.2, 489.1, 489.2, 712, 715

(56) References Cited

U.S. PATENT DOCUMENTS

| | | | | |
|---|---|---|---|---|
| 2,316,668 | * | 4/1943 | Bronner | 52/481.2 |
| 2,779,978 | * | 2/1957 | Sundelin et al. | 52/489.2 X |
| 3,300,924 | * | 1/1967 | Ashby et al. | 52/489.1 X |
| 3,324,615 | | 6/1967 | Zinn . | |
| 3,611,653 | | 10/1971 | Zinn . | |
| 3,753,325 | * | 8/1973 | Stanley et al. | 52/481.2 |
| 3,922,764 | * | 12/1975 | Downing, Jr. | 52/481.2 |
| 3,972,167 | | 8/1976 | Vogeli . | |
| 4,112,647 | * | 9/1978 | Scheid | 52/481.2 |
| 4,394,808 | * | 7/1983 | Thorsell | 52/489.2 |
| 4,487,291 | | 12/1984 | Walker . | |
| 4,835,923 | * | 6/1989 | Ybarra | 52/481.2 X |
| 5,775,048 | * | 7/1998 | Orchard | 52/712 |
| 5,787,651 | | 8/1998 | Hon et al. . | |

* cited by examiner

*Primary Examiner*—Carl D. Friedman
*Assistant Examiner*—Kevin D. Wilkens
(74) *Attorney, Agent, or Firm*—John D. Lister

(57) ABSTRACT

A sound attenuating wall or ceiling assembly includes: a plurality of wall or ceiling boards; a series of parallel spaced apart, elongated framing members; and a series of elongated sound attenuating members extending along the length of the framing members, secured to the framing members and securing the boards to the framing members. Each of the sound attenuating members has a resilient cantilevered portion to which the boards are secured. The cantilevered portion of each sound attenuating member extends from the framing member to which the sound attenuating member is secured both outward away from the framing member and toward an adjacent framing member whereby the boards are resiliently secured to the framing members and spaced outwardly from the framing members to attenuate sound.

35 Claims, 2 Drawing Sheets

SOUND ATTENUATING AND THERMAL INSULATING WALL AND CEILING ASSEMBLY

BACKGROUND OF THE INVENTION

The present invention relates to sound attenuating and thermal insulating wall and ceiling assemblies, and, in particular, to a sound attenuating and thermal insulating wall and ceiling assembly which utilizes sound attenuating or sound attenuating and thermal insulating members, with resilient cantilevered portions, for securing wall or ceiling boards to the framing members of the wall or ceiling assembly. The sound attenuating or sound attenuating and thermal insulating members extend along the length of the framing members with the resilient cantilevered portions of the sound attenuating or sound attenuating and thermal insulating members projecting outward from the framing members so that a) boards secured to the framing members through the sound attenuating or sound attenuating and thermal insulating members are spaced outwardly from the framing members and b) fasteners used to secure the boards to the sound attenuating or sound attenuating and thermal insulating members do not come in contact with or penetrate the framing members. This construction isolates the wall or ceiling boards from the framing members except through the resilient cantilevered portions of the sound attenuating or sound attenuating and thermal insulating members.

Various structures have been used in the wall and ceiling assemblies of buildings to attenuate sound and reduce the transmission of undesirable sounds through such wall and ceiling assemblies, especially in buildings such as apartment buildings, motels and hotels. By way of example, U.S. Pat. No. 3,324,615, issued Jun. 13, 1967, and U.S. Pat. No. 3,611,653, issued Oct. 12, 1971, disclose wall partitions which utilize channel shaped framing members having side flanges with a series of longitudinally spaced resilient wallboard engaging and supporting tabs to attenuate sound. U.S. Pat. No. 3,972,167, issued Aug. 3, 1976, discloses a wall partition wherein gaps are provided between the wall panels and the framing members. U.S. Pat. No. 4,487,291, issued Dec. 11, 1984, discloses a wall assembly wherein sound attenuation within the wall assembly is enhanced by a bowed blanket of mineral fibers within the wall assembly. U.S. Pat. No. 5,787,651, issued Aug. 4, 1998, discloses a sound deadening wall assembly which utilizes a resilient attachment material to secure first and second stud members of the wall assembly to each other.

FIG. 9 shows a wall assembly currently used in the building industry which utilizes resilient sound attenuating members for decoupling the structural sound path in wood-stud, framed gypsum board partitions. As shown, the resilient sound attenuating members extend perpendicular to the lengths of the wood-stud framing members rather than along the lengths of the framing members. In the construction of the wall assembly, the resilient sound attenuating members must be carefully secured to the wood-stud framing members to extend horizontally so that, when gypsum boards are placed over the resilient sound attenuating members, the laborers will know where to place the fasteners securing the gypsum boards to the resilient sound attenuating members. Then, the fasteners securing the gypsum boards to the resilient sound attenuating members must be carefully screwed into the outer flanges of the members. The structure shown has proven to be an effective sound control measure. However, the added labor and time required for building these wall assemblies has made the use of such wall assemblies prohibitively expensive as a sound control measure in any instances and it is estimated that this type of structure is used for sound control in fewer than 10% of wood stud applications.

SUMMARY OF THE INVENTION

The sound attenuating or sound attenuating and thermal insulating wall or ceiling assembly of the present invention and the sound attenuating or sound attenuating and thermal insulating member of the present invention should reduce the labor required for and cost of making wall and ceiling assemblies with resilient sound attenuating members.

The sound attenuating or sound attenuating and thermal insulating wall or ceiling assembly of the present invention includes: a plurality of wall or ceiling boards; a series of parallel spaced apart, elongated framing members; and a series of elongated sound attenuating or sound attenuating and thermal insulating members extending along the length of the framing members, secured to the framing members and securing the boards to the framing members. The sound attenuating or sound attenuating and thermal insulating members each include: a longitudinally extending web; preferably, a first flange or series of tabs projecting inwardly from a first lateral edge portion of the web or first and second flanges or series of tabs projecting inwardly from both lateral edge portions of the web; and a resilient cantilevered portion projecting outwardly from the second lateral edge portion of the web and away from a longitudinal centerline of the web for securing the wall or ceiling boards to a framing member through the sound attenuating or sound attenuating and thermal insulating member.

The flanges or series of tabs of the sound attenuating or sound attenuating and thermal insulating members allow a worker to easily and properly align the sound attenuating or sound attenuating and thermal insulating members along the lengths of elongated framing members, e.g. wall or partition studs or ceiling joists, and hold the sound attenuating or sound attenuating and thermal insulating members in place while securing the sound attenuating or sound attenuating and thermal insulating members to the framing members. Thus, the sound attenuating or sound attenuating and thermal insulating members of the present invention can be easily, rapidly and properly installed by even an unskilled construction worker.

The resilient cantilevered portions of the sound attenuating or sound attenuating and thermal insulating members, which project outwardly from the second lateral edge portions of the webs and away from the longitudinal centerlines of the webs, enable the wall or ceiling boards to be easily secured to the framing members through the sound attenuating or sound attenuating and thermal insulating member without having to be concerned about contacting or penetrating the framing members with the fasteners securing the boards to the cantilevered portion. Furthermore, by using a stud finder and knowing that the cantilevered portions of the sound attenuating or sound attenuating and thermal insulating members project outwardly from one side of each stud, the cantilevered portions of the sound attenuating or sound attenuating and thermal insulating members can be easily located behind wall and ceiling boards for placement of the fasteners securing the wall and ceiling boards to the cantilevered portions of the sound attenuating or sound attenuating and thermal insulating members.

DESCRIPTION OF THE PREFERRED EMBODIMENTS

The sound attenuating or sound attenuating and thermal insulating wall or ceiling assembly 20 of the present invention includes: a plurality of wall or ceiling boards 22; a series of parallel spaced apart, elongated framing members 24; and a series of elongated sound attenuating or sound attenuating and thermal insulating members 26 or 126 extending along the length of the framing members, secured to the framing members and securing the boards to the framing members. Typically, the wall and ceiling boards 22 are four foot by eight foot gypsum boards commonly used in both the residential and commercial construction industry. These wall or ceiling boards 22 can be secured to the framing members in single layers, as shown in FIGS. 1 and 2, or in multiple layers, e.g. as shown in FIG. 4.

Figure 1:
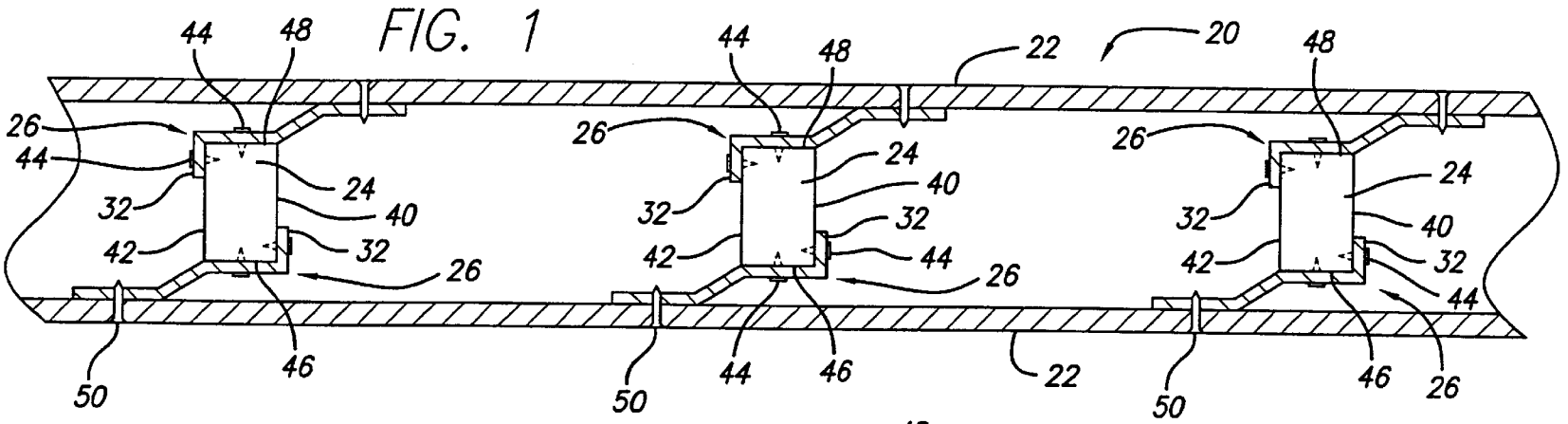
FIG. 1 is a horizontal cross section through a wall assembly of the present invention.
Figure 4:
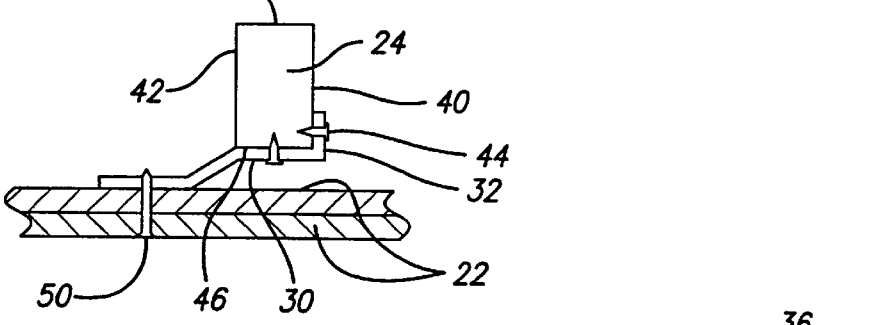
FIG. 4 is a transverse cross section through a framing member and the sound attenuating or sound attenuating and thermal insulating member of FIG. 3 showing a wall or ceiling board secured to the framing member through the sound attenuating or sound attenuating and thermal insulating member.
Figure 3:
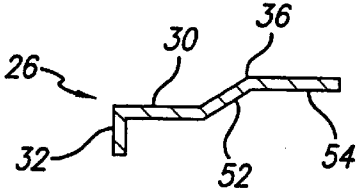
FIG. 3 is a transverse cross section through a first embodiment of the sound attenuating or sound attenuating and thermal insulating member of the present invention.
Figure 2:
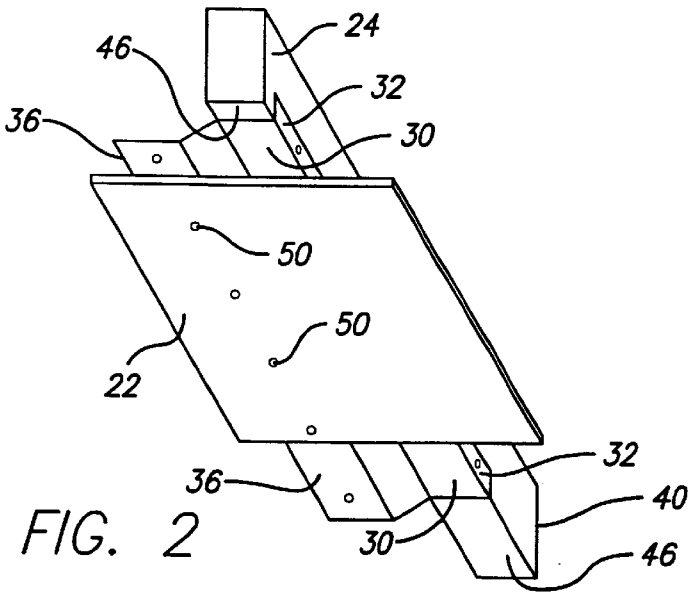
FIG. 2 is a partial perspective view of a wall or ceiling assembly of the present invention.
Figure 7:
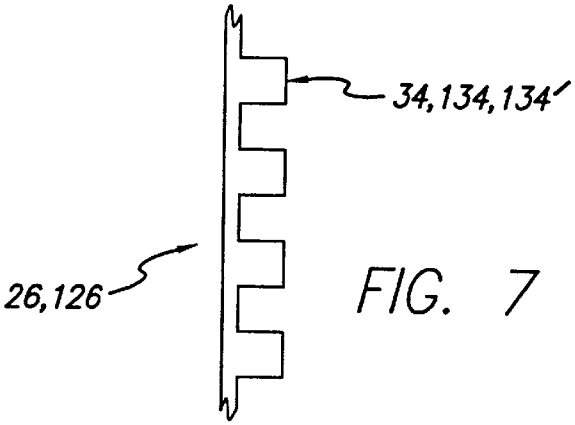
FIG. 7 is a view of the sound attenuating or sound attenuating and thermal insulating member of FIG. 3 or 5, showing a series of tabs substituted for a flange of the sound attenuating or sound attenuating and thermal insulating member.
Figure 9:
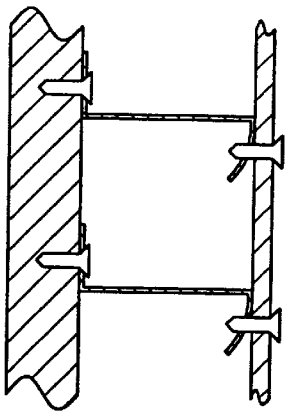
FIG. 9 PRIOR ART
FIG. 9 is a partial vertical cross section through a prior art sound attenuating wall assembly.
Figure 6:
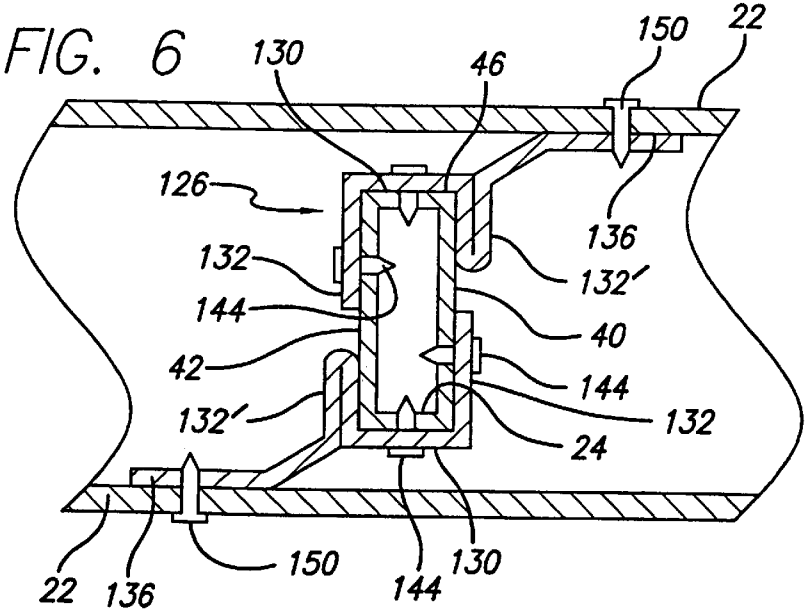
FIG. 6 is a transverse cross section through a framing member and the sound attenuating or sound attenuating and thermal insulating member of FIG. 5 showing a wall or ceiling board secured to the framing member through the sound attenuating or sound attenuating and thermal insulating member.

The framing members 24 are typically wooden framing members, such as shown in FIGS. 1, 2 and 4, or metal framing members, such as shown in FIG. 6, commonly used in the residential and commercial construction industry. Examples of such framing members are: wooden studs, e.g. 2×4 or 2×6 wooden studs extending within a wall from a floor to a ceiling of a structure; wooden joists, e.g. 2×10 wooden joists extending within a ceiling between opposed walls of a structure; or upright or horizontal metal channels used as studs or joists and extending within a wall from a floor to a ceiling of a structure or within a ceiling between opposed walls of a structure. As used herein, the term "wall" also includes temporary or permanent partition structures.

As shown in FIGS. 1–4 and 7, a first embodiment 26 of the sound attenuating or sound attenuating and thermal insulating member includes: a longitudinally extending web 30; preferably, a flange 32 or series of tabs 34 projecting inwardly from a first lateral edge portion of the web; and a resilient cantilevered portion 36 projecting outwardly from a second lateral edge portion of the web and away from a longitudinal centerline of the web for securing a wall or ceiling board 22 to a framing member 24 through the sound attenuating or sound attenuating and thermal insulating member 26.

The sound attenuating or sound attenuating and thermal insulating members 26 are typically about 8 to 12 feet in length. When the member 26 is being used only to attenuate the passage of sound through a wall or ceiling, the member 26 is preferably made of a resilient metal, such as but not limited to a 25 gauge mild steel or spring steel. The use of a sound attenuating member 26, made of a resilient metal, in a wall or ceiling assembly 20 would be common for interior walls, partitions and ceilings. When the member 26 is being used to attenuate both the passage of sound and heat through a wall or ceiling, the member 26 is preferably made of a resilient material with a low thermal conductivity, such as but not limited to an ABS plastic. The use of a sound attenuating and thermal insulating member 26, made of a resilient material with a low thermal conductivity, in a wall or ceiling assembly 20 would be common for exterior walls and walls, partitions and ceilings separating a heated or air conditioned portion of a building from a non-heated or non-air conditioned portion of a building.

The web 30 of the sound attenuating or sound attenuating and thermal insulating member 26 is coextensive in length with the member 26. The web 30 has an inner major surface which overlays a longitudinally extending end surface of a framing member 24 to which the sound attenuating or sound attenuating and thermal insulating member 26 is secured and an outer major surface which opposes an inner major surface of the wall or ceiling boards 22 secured to the framing member 24 through the sound attenuating or sound attenuating and thermal insulating member 26.

Preferably, the flange 32 or series of tabs 34 of the sound attenuating or sound attenuating and thermal insulating member 26 extends inwardly from the web 30 at right angles to the inner major surface of the web for the length of the member 26. The flange 32 or the series of tabs 34 allow a worker to easily align and properly position the sound attenuating or sound attenuating and thermal insulating member 26 along the length of an elongated framing member 24 (e.g. wall or partition studs or ceiling joists) and hold the sound attenuating or sound attenuating and thermal insulating member 26 in place while securing the sound attenuating or sound attenuating and thermal insulating member 26 to a longitudinally extending side surface 40 or 42 and/or a longitudinally extending end surface 46 or 48 of the framing member 24 with nails, screws or other fasteners 44. Thus, as mentioned above, the sound attenuating or sound attenuating and thermal insulating members 26 of the present invention can be easily, rapidly and properly installed by even an unskilled construction worker.

The amount of resilient metal or plastic used to make a sound attenuating or sound attenuating and thermal insulating member 26 can be reduced and thus, the cost of making the member 26 can be reduced by using the series of tabs 34 along the length of the member 26, rather than a single continuous flange 32 extending the length of the member 26, to align the member 26 with and secure the member 26 to the framing member 24.

Preferably, the resilient cantilevered portion 36 of the sound attenuating or sound attenuating and thermal insulating member 26 extends for the length of member 26. The resilient cantilevered portion 36 of the sound attenuating or sound attenuating and thermal insulating member 26 projects outwardly from the second lateral edge portion of the web 30 and away from the longitudinal centerline of the web 30. As shown in FIG. 1, the longitudinally extending end surfaces 46 and 48 of the framing members 24, which oppose the major surfaces of the wall or ceiling boards 22, each lie in a common or substantially common plane. Since the web 30 of each sound attenuating or sound attenuating and thermal insulating member 26 overlays an end surface 46 or 48 of a framing member 24, the cantilevered portion 36 of the member 26 also projects outwardly from the common or substantially common plane of the end surfaces 46 and 48 and away from the longitudinal centerline of the framing member 24 toward an adjacent framing member. This spaces the wall or ceiling boards 22 outwardly away from the end surfaces 46 and 48 of the framing members 24 and locates the resilient cantilevered portions of the members 26 beyond the side surfaces 40 and 42 of the framing members to enable the wall or ceiling boards 22 to be easily secured to the framing members 24 through the sound attenuating or sound attenuating and thermal insulating members 26 without having to be concerned about contacting or penetrating the framing members 24 with the fasteners 50 securing the boards 22 to the cantilevered portions 36.

Figure 8:
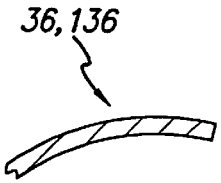
FIG. 8 is transverse cross section through an arcuate cantilevered portion of a sound attenuating or sound attenuating and thermal insulating member which can be used on the sound attenuating or sound attenuating and thermal insulating members of FIG. 3 or 5.

As shown in FIGS. 1–4, the cantilevered portion 36 of the sound attenuating or sound attenuating and thermal insulating member 26 has a first section 52 extending outward from the lateral edge of the web 30 at an acute angle, e.g. an angle between 30° and 60°, to the plane of the web 30 and a second section 54 spaced outwardly from and extending generally parallel to the plane of the web 30 for securing the boards 22 to the member 26. Another configuration for the cantilevered portion 36 of the member 26 is shown in FIG. 8 where the cantilevered portion 36 has a generally arcuate transverse cross section. Preferably, the cantilevered portion 36 extends outward from the web 30 at an acute angle to the plane of the web 30 of less than 90°, e.g. an angle between 30° and 60°, as shown in FIGS. 1–4, or has a generally arcuate cross section, as shown in FIG. 8, to better attenuate sound through the resilience of the cantilevered portion 36 of the member 26. While not shown, the juncture of the cantilevered portion 36 with the web 30 can be slotted to increase the flexibility or resilience of the cantilevered portion 36 and its sound attenuating and thermal insulating properties.

Figure 5:
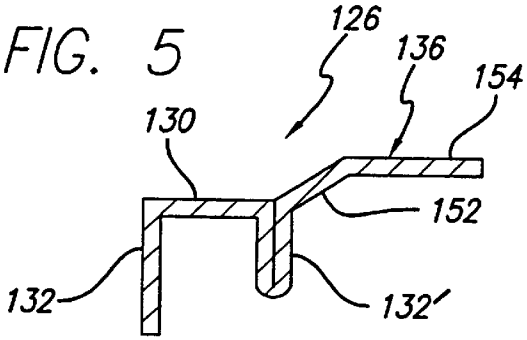
FIG. 5 is a transverse cross section through a second embodiment of the sound attenuating or sound attenuating and thermal insulating member of the present invention.

As shown in FIGS. 5 and 6, a second embodiment 126 of the sound attenuating or sound attenuating and thermal insulating member includes: a longitudinally extending web 130; a first flange 132 or series of tabs 134 projecting inwardly from a first lateral edge portion of the web 130; a second flange 132' or series of tabs 134' projecting inwardly from the second lateral edge portion of the web 130; and a resilient cantilevered portion 136 projecting outwardly from the second lateral edge portion of the web and away from a longitudinal centerline of the web for securing the wall or ceiling boards 22 to a framing member 24 through the sound attenuating or sound attenuating and thermal insulating member.

The sound attenuating or sound attenuating and thermal insulating members 126 are typically about 8 to 12 feet in length. As with the member 26, when the member 126 is being used only to attenuate the passage of sound through a wall or ceiling, the member 126 is preferably made of a resilient metal, such as but not limited to a 25 gauge mild steel or spring steel. The use of a sound attenuating member 126, made of a resilient metal, in a wall or ceiling assembly 20 would be common for interior walls, partitions and ceilings. When the member 126 is being used to attenuate both the passage of sound and heat through a wall or ceiling, the member 126 is preferably made of a resilient material with a low thermal conductivity, such as but not limited to an ABS plastic. The use of a sound attenuating and thermal insulating member 126, made of a resilient material with a low thermal conductivity, in a wall or ceiling assembly 20 would be common for exterior walls and walls, partitions and ceilings separating a heated or air conditioned portion of a building from a non-heated or non-air conditioned portion of a building.

The web 130 of the sound attenuating or sound attenuating and thermal insulating member 126 is coextensive in length with the member 126. The web 130 has an inner major surface which overlays a longitudinally extending end surface of a framing member 24 to which the sound attenuating or sound attenuating and thermal insulating member 126 is secured and an outer major surface which opposes an inner major surface of the wall or ceiling boards 22 secured to the framing member 24 through the sound attenuating or sound attenuating and thermal insulating member 126.

Preferably, the resilient flanges 132, 132' or series of tabs 134, 134' of the sound attenuating or sound attenuating and thermal insulating member 126 extend inwardly from the web 130 at substantially right angles to the inner major surface of the web 130 for the length of the member 126. Preferably, the resilient flanges 132, 132' or series of tabs 134, 134' are spaced from each other a distance substantially equal to or less than the width of the end surfaces 46 and 48 of the framing members 24. With this spacing between the resilient flanges 132, 132' or tabs 134, 134', the resilient flanges 132, 132' or tabs 134, 134' can be easily slipped over the sides 40 and 42 of the framing member by a worker to align and properly position the sound attenuating or sound attenuating and thermal insulating member 126 along the length of elongated framing member 24, e.g. wall or partition studs or ceiling joists. The resilient flanges 132, 132' or tabs 134, 134' will hold or make it easy for the worker to hold the sound attenuating or sound attenuating and thermal insulating member 126 in place while securing the sound attenuating or sound attenuating and thermal insulating member 126 to a longitudinally extending side surface 40 or 42 and/or a longitudinally extending end surface 46 or 48 of the framing member 24 with nails, screws or other fasteners 144. Where the spacing between the resilient flanges 132, 132' or tabs 134, 134' is about equal to but less than the width of the end surfaces 46 and 48 of the framing members, the resilience of the flanges 132, 132' or tabs 134, 134' can be used to clamp the member 126 in place on the framing member and the number of fasteners used to secure the sound attenuating or sound attenuating and thermal insulating member 126 to the framing member 24 may be greatly reduced or eliminated or an adhesive may be used instead of fasteners to help secure the member 126 to the framing member 24.

As with the embodiment 26 of FIGS. 1–4, the amount of resilient metal or plastic used to make a sound attenuating or sound attenuating and thermal insulating member 126 is reduced and thus, the cost of making the member 126 can be reduced by using a series of tabs 134 or 134' along the length of the member 126, rather than a single continuous flange 132 or 132' extending the length of the member 126.

Preferably, the resilient cantilevered portion 136 of the sound attenuating or sound attenuating and thermal insulating member 126 extends for the length of member 126. The resilient cantilevered portion 136 of the sound attenuating or sound attenuating and thermal insulating member 126 projects outwardly from adjacent the second lateral edge portion of the web 130 and away from the longitudinal centerline of the web 130. As in the structure shown in FIG. 1, the longitudinally extending end surfaces 46 and 48 of the framing members 24, which oppose the major surfaces of the wall or ceiling boards 22, each lie in a common or substantially common plane. Since the web 130 of each sound attenuating or sound attenuating and thermal insulating member 126 overlays an end surface 46 or 48 of a framing member 24, the cantilevered portion 136 of the member 126 also projects outwardly from the common or substantially common plane of the end surfaces 46 and 48 and away from the longitudinal centerline of the framing member 24 toward an adjacent framing member. This spaces the wall or ceiling boards 22 outwardly away from the end surfaces 46 and 48 of the framing members 24 and locates the resilient cantilevered portions 136 of the members 126 beyond the side surfaces 40 and 42 of the framing members to enable the wall or ceiling boards 22 to be easily secured to the framing members 24 through the sound attenuating or sound attenuating and thermal insulating members 126 without having to be concerned about contacting or penetrating the framing members 24 with the fasteners 150 securing the boards 22 to the cantilevered portions 136.

As shown in FIGS. 5 and 6, cantilevered portion 136 of the sound attenuating or sound attenuating and thermal insulating member 126 has a first section 152 extending outward from the lateral edge of the web 130 at an acute angle, e.g. an angle between 30° and 60°, to the plane of the web 130 and a second section 154 spaced outwardly from and extending generally parallel to the plane of the web 130 for securing the boards 22 to the member 126. Another configuration for the cantilevered portion 136 is shown in FIG. 8 where the cantilevered portion has a generally arcuate transverse cross section. Preferably, the cantilevered portion 136 extends outward from the plane of the web 130 at an acute angle of less than 90°, e.g. an angle between 30° and 60°, as shown in FIGS. 5 and 6, or has this generally arcuate cross section, as shown in FIG. 8, to better attenuate sound through the resilience of the cantilevered portion 136 of the member 126. While not shown, the juncture of the cantilevered portion 136 with the web 130 can be slotted to increase the flexibility or resilience of the cantilevered portion 136 and its sound attenuating and thermal insulating properties.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A sound attenuating wall or ceiling assembly comprising:

a plurality of wall or ceiling boards; the boards having major surfaces;

a series of parallel spaced apart, elongated framing members; each of the framing members having longitudinal centerlines; each of the framing members having first end surfaces which oppose the major surfaces of the boards; the first end surfaces of the framing members lying substantially in a common plane; and a first series of sound attenuating members, for securing the boards to the framing members, secured to the framing members; each of the sound attenuating members being elongated and having a longitudinal centerline extending parallel to the longitudinal centerline of the framing member to which the sound attenuating member is secured; and each of the sound attenuating members having resilient cantilevered means to which the boards are secured extending outward beyond the framing member to which the sound attenuating member is secured toward an adjacent framing member and outward beyond the plane of the first end surfaces of the framing members whereby the boards are resiliently secured to the framing members and spaced outwardly from the framing members to attenuate sound; and the resilient cantilevered means of each of the sound attenuating members having a first section extending outward from the plane of the first end surfaces of the framing members at an acute angle to the plane of the first end surfaces of the framing members and a second section extending from the first section generally parallel to and spaced outwardly from the plane of the first end surfaces.

2. The sound attenuating wall or ceiling assembly according to claim 1, wherein: the sound attenuating members are clamped to the framing members.

3. The sound attenuating wall or ceiling assembly according to claim 1, wherein: the sound attenuating members are made of plastic to thermally insulate the wall or ceiling assembly.

4. The sound attenuating wall or ceiling assembly according to claim 1, wherein: the resilient cantilevered means of each of the sound attenuating members is substantially coextensive in length with the sound attenuating member.

5. The sound attenuating wall or ceiling assembly according to claim 4, wherein: the resilient cantilevered means of each of the sound attenuating members is continuous in length.

6. The sound attenuating wall or ceiling assembly according to claim 1, wherein:

a second plurality of wall or ceiling boards; the second plurality of boards having major surfaces;

each of the framing members have second end surfaces which oppose the major surfaces of the second plurality of boards; the second end surfaces of the framing members lying substantially in a common plane; and a second series of sound attenuating members, for securing the second plurality of boards to the framing members, secured to the framing members; each of the second series of sound attenuating members being elongated and having a longitudinal centerline extending parallel to the longitudinal centerline of the framing member to which the sound attenuating member is secured; and each of the second series of sound attenuating members having resilient cantilevered means to which the second plurality of boards are secured extending outward beyond the framing member to which the sound attenuating member is secured toward an adjacent framing member and outward beyond the plane of the second end surfaces of the framing members whereby the second plurality of boards are resiliently secured to the framing members and spaced outwardly from the framing members to attenuate sound; and the resilient cantilevered means of each of the second series of sound attenuating members has a first section extending outward from the plane of the second end surfaces of the framing members at an acute angle to the plane of the second end surfaces of the framing members and a second section extending from the first section generally parallel to and spaced outwardly from the plane of the second end surfaces.

7. The sound attenuating wall or ceiling assembly according to claim 6, wherein: the resilient cantilevered means of each of the second series of sound attenuating members is substantially coextensive in length with the sound attenuating member.

8. The sound attenuating wall or ceiling assembly according to claim 7, wherein: the resilient cantilevered means of each of the second series of sound attenuating members is continuous in length.

9. The sound attenuating wall or ceiling assembly according to claim 6, wherein: the sound attenuating members of the first and second series of sound attenuating members are clamped to the framing members.

10. The sound attenuating wall or ceiling assembly according to claim 6, wherein: the sound attenuating members of the first and second series of sound attenuating members are made of plastic to thermally insulate the wall or ceiling assembly.

11. A sound attenuating wall or ceiling assembly comprising:

a plurality of wall or ceiling boards; the boards having major surfaces;

a series of parallel spaced apart, elongated framing members; each of the framing members having longitudinal centerlines; each of the framing members having first end surfaces which oppose the major surfaces of the boards; the first end surfaces of the framing members lying substantially in a common plane; and a first series of sound attenuating members, for securing the boards to the framing members, secured to the framing members; each of the sound attenuating members being elongated and having a longitudinal centerline extending parallel to the longitudinal centerline of the framing member to which the sound attenuating member is secured; and each of the sound attenuating members having resilient cantilevered means to which the boards are secured extending outward beyond the framing member to which the sound attenuating member is secured toward an adjacent framing member and outward beyond the plane of the first end surfaces of the framing members whereby the boards are resiliently secured to the framing members and spaced outwardly from the framing members to attenuate sound; and the resilient cantilevered means of each of the sound attenuating members has a generally arcuate transverse cross section.

12. The sound attenuating wall or ceiling assembly according to claim 11, wherein: the sound attenuating members are clamped to the framing members.

13. The sound attenuating wall or ceiling assembly according to claim 11, wherein: the sound attenuating members are made of plastic to thermally insulate the wall or ceiling assembly.

14. The sound attenuating wall or ceiling assembly according to claim 11, wherein: the resilient cantilevered means of each of the sound attenuating members is substantially coextensive in length with the sound attenuating member.

15. The sound attenuating wall or ceiling assembly according to claim 14, wherein: the resilient cantilevered means of each of the sound attenuating members is continuous in length.

16. The sound attenuating wall or ceiling assembly according to claim 11, wherein:

a second plurality of wall or ceiling boards; the second plurality of boards having major surfaces;

each of the framing members have second end surfaces which oppose the major surfaces of the second plurality of boards; the second end surfaces of the framing members lying substantially in a common plane; and a second series of sound attenuating members, for securing the second plurality of boards to the framing members, secured to the framing members; each of the second series of sound attenuating members being elongated and having a longitudinal centerline extending parallel to the longitudinal centerline of the framing member to which the sound attenuating member is secured; and each of the second series of sound attenuating members having resilient cantilevered means to which the second plurality of boards are secured extending outward beyond the framing member to which the sound attenuating member is secured toward an adjacent framing member and outward beyond the plane of the second end surfaces of the framing members whereby the second plurality of boards are resiliently secured to the framing members and spaced outwardly from the framing members to attenuate sound; and the resilient cantilevered means of each of the second series of sound attenuating members has a generally arcuate transverse cross section.

17. The sound attenuating wall or ceiling assembly according to claim 16, wherein: the sound attenuating members of the first and second series of sound attenuating members are clamped to the framing members.

18. The sound attenuating wall or ceiling assembly according to claim 16, wherein: the sound attenuating members of the first and second series of sound attenuating members are made of plastic to thermally insulate the wall or ceiling assembly.

19. The sound attenuating wall or ceiling assembly according to claim 16, wherein: the resilient cantilevered means of each of the second series of sound attenuating members is substantially coextensive in length with the sound attenuating member.

20. The sound attenuating wall or ceiling assembly according to claim 19, wherein: the resilient cantilevered means of each of the second series of sound attenuating members is continuous in length.

21. A sound attenuating member for securing a wall or ceiling board to a framing member in a wall or ceiling assembly comprising:

an elongated web for overlaying at least a portion of a longitudinally extending end surface of a framing member; the web having a longitudinally extending centerline, an inner major surface, and an outer major surface; a first flange means substantially coextensive in length with the web and projecting inward at a substantially right angle from the inner major surface of the web at a first lateral edge portion of the web for overlaying at least a portion of a longitudinally extending side surface of a framing member; and a resilient cantilevered means for securement to wall or ceiling boards; the resilient cantilevered means being substantially coextensive in length with the web and extending generally outward from a plane containing the outer major surface of the web and away from the centerline of the web beyond a second lateral edge portion of the web to locate a portion of the resilient cantilevered means to which a board is secured in a plane generally parallel to and spaced outwardly from the plane containing the outer major surface of the web and beyond the second lateral edge portion of the web whereby a wall or ceiling board may be secured to a framing member through the elongated member to attenuate sound; and the resilient cantilevered means having a first section extending outward from the plane of the outer major surface of the web at an acute angle to the plane of the outer major surface of the web and a second section extending from the first section generally parallel to and spaced outwardly from the plane of the outer major surface of the web.

22. The sound attenuating member according to claim 21, wherein: the resilient cantilevered means is continuous in length.

23. The sound attenuating member according to claim 21, wherein: the first flange means is continuous in length.

24. The sound attenuating member according to claim 21, wherein: the first flange means is a series of tabs.

25. The sound attenuating member according to claim 21, wherein: the sound attenuating member is between about 8 feet and about 12 feet in length.

26. The sound attenuating member according to claim 21, wherein: the sound attenuating member is made of plastic to thermally insulate the wall or ceiling assembly.

27. The sound attenuating member according to claim 21, including: a second flange means substantially coextensive in length with the web and projecting inward at a substantially right angle from the inner major surface of the web at the second lateral edge portion of the web for overlaying at least a portion of a second longitudinally extending side surface of a framing member.

28. The sound attenuating member according to claim 27, wherein: the resilient cantilevered means is continuous in length.

29. A sound attenuating member for securing a wall or ceiling board to a framing member in a wall or ceiling assembly comprising:

an elongated web for overlaying at least a portion of a longitudinally extending end surface of a framing member; the web having a longitudinally extending centerline, an inner major surface, and an outer major surface; a first flange means substantially coextensive in length with the web and projecting inward at a substantially right angle from the inner major surface of the web at a first lateral edge portion of the web for overlaying at least a portion of a longitudinally extending side surface of a framing member; a second flange means substantially coextensive in length with the web and projecting inward at a substantially right angle from the inner major surface of the web at a second lateral edge portion of the web for overlaying at least a portion of a second longitudinally extending side surface of a framing member and a resilient cantilevered means for securement to wall or ceiling boards; the resilient cantilevered means being substantially coextensive in length with the web and extending generally outward from a plane containing the outer major surface of the web and away from the centerline of the web beyond the second lateral edge portion of the web to locate a portion of the resilient cantilevered means to which a board is secured in a plane generally parallel to and spaced outwardly from the plane containing the outer major surface of the web and beyond the second lateral edge portion of the web whereby a wall or ceiling board may be secured to a framing member through the elongated member to attenuate sound.

30. The sound attenuating member according to claim 29, wherein: the resilient cantilevered means has a generally arcuate transverse cross section.

31. The sound attenuating member according to claim 29, wherein: the resilient cantilevered means is continuous in length.

32. The sound attenuating member according to claim 29, wherein: the first and the second flange means are continuous in length.

33. The sound attenuating member according to claim 29, wherein: the first and the second flange means are a series of tabs.

34. The sound attenuating member according to claim 29, wherein: the sound attenuating member is between about 8 feet and about 12 feet in length.

35. The sound attenuating member according to claim 29, wherein: the sound attenuating member is made of plastic to thermally insulate the wall or ceiling assembly.

* * * * *